US009950368B2

(12) United States Patent
Lampenscherf et al.

(10) Patent No.: US 9,950,368 B2
(45) Date of Patent: Apr. 24, 2018

(54) PRODUCTION OF A REFRACTORY METAL COMPONENT

(71) Applicant: SIEMENS AKTIENGESELLSCHAFT, München (DE)

(72) Inventors: Stefan Lampenscherf, Poing (DE); Mathias Sommerer, München (DE); Steffen Walter, Oberpframmern (DE); Ewald Werner, Freising (DE); Hubertus von Dewitz, München (DE)

(73) Assignee: Siemens Aktiengesellschaft, München (DE)

( * ) Notice: Subject to any disclaimer, the term of this patent is extended or adjusted under 35 U.S.C. 154(b) by 341 days.

(21) Appl. No.: 14/430,264

(22) PCT Filed: Jul. 18, 2013

(86) PCT No.: PCT/EP2013/065198
§ 371 (c)(1),
(2) Date: Mar. 23, 2015

(87) PCT Pub. No.: WO2014/044429
PCT Pub. Date: Mar. 27, 2014

(65) Prior Publication Data

US 2015/0224576 A1 Aug. 13, 2015

(30) Foreign Application Priority Data

Sep. 24, 2012 (DE) ..... 10 2012 217 191

(51) Int. Cl.
*B22F 3/22* (2006.01)
*C22C 1/04* (2006.01)
(Continued)

(52) U.S. Cl.
CPC ..... *B22F 3/22* (2013.01); *B22F 7/02* (2013.01); *B28B 1/26* (2013.01); *B28B 1/30* (2013.01);
(Continued)

(58) Field of Classification Search
CPC ..... B22F 3/22; B22F 7/02; B22F 2999/00; B22F 5/006; B28B 1/26; B28B 5/027;
(Continued)

(56) References Cited

U.S. PATENT DOCUMENTS 3,052,532 A 9/1962 Cowan
3,322,536 A * 5/1967 Stoddard ..... B22F 1/0088 264/0.5

(Continued)

FOREIGN PATENT DOCUMENTS

DE 69903858 7/2003
DE 60015255 T2 2/2006

(Continued)

OTHER PUBLICATIONS

Mistler, R.E., "The principles of tape casting and tape casting applications," Ceramic Processing, Chapman & Hall, London, Published 1995.*

(Continued)

*Primary Examiner* — Anthony J Zimmer
(74) *Attorney, Agent, or Firm* — Lempia Summerfield Katz LLC

(57) ABSTRACT

The embodiments relate to a method for the production of a refractory metal component by casting. The method includes providing a slip that contains a powder including at least one refractory metal or a compound thereof, in addition to at least one binding agent. The method further includes processing the slip by casting, (e.g., film casting or slip casting), to form at least one slip coating, the slip being devoid of a (Continued)

metal binding agent. A component was produced by this method. The embodiments may be used, in particular, on X-ray tubes, accelerator targets, or fusion reactors, such as for a surface of an X-ray anode, or a wall of a fusion reactor.

17 Claims, 2 Drawing Sheets

(51) Int. Cl.

| | |
|---|---|
| ***B22F 7/02*** | (2006.01) |
| ***C22C 32/00*** | (2006.01) |
| ***B28B 1/30*** | (2006.01) |
| ***B28B 5/02*** | (2006.01) |
| ***B28B 1/26*** | (2006.01) |
| ***B22F 5/00*** | (2006.01) |
| ***C22C 1/08*** | (2006.01) |

(52) U.S. Cl.
CPC ..... *B28B 5/027* (2013.01); *C22C 1/045* (2013.01); *C22C 32/00* (2013.01); *B22F 5/006* (2013.01); *B22F 2999/00* (2013.01); *C22C 1/08* (2013.01); *C22C 32/0031* (2013.01); *C22C 32/0052* (2013.01)

(58) Field of Classification Search
CPC ..... B28B 1/30; C22C 32/00; C22C 1/045; C22C 1/08; C22C 32/0052; C22C 32/0031
See application file for complete search history.

(56) References Cited

U.S. PATENT DOCUMENTS

| | | | | |
|---|---|---|---|---|
| 5,256,609 | A * | 10/1993 | Dolhert | C04B 35/63408 156/89.27 |
| 5,420,399 | A * | 5/1995 | Sekhar | C04B 35/651 219/553 |
| 6,596,100 | B2 | 7/2003 | Niimi | |
| 2002/0060520 | A1 | 5/2002 | Niimi | |
| 2007/0172378 | A1 | 7/2007 | Shibuya et al. | |
| 2011/0206944 | A1 | 8/2011 | Uhlenhut et al. | |

FOREIGN PATENT DOCUMENTS

| | | | | |
|---|---|---|---|---|
| EP | 0325179 | | 7/1989 | |
| EP | 1195214A1 | A1 | 4/2002 | |
| EP | 1077099B1 | B1 | 10/2004 | |
| WO | WO 0040359 | A1 * | 7/2000 | B22F 1/004 |
| WO | WO2007147792 | | 12/2007 | |

OTHER PUBLICATIONS

European Search Report and Written Opinion cited in PCT/EP2013/065198, dated Oct. 24, 2013.
German Search Report cited in DE102012217191.6, dated Apr. 25, 2013.
Chinese Office Action for related Chinese Application No. 201380054052.0, dated Oct. 23, 2015, with English Translation.

* cited by examiner

PRODUCTION OF A REFRACTORY METAL COMPONENT

CROSS-REFERENCE TO RELATED APPLICATIONS

The present patent document is a § 371 nationalization of PCT Application Serial Number PCT/EP2013/065198, filed Jul. 18, 2013, designating the United States, which is hereby incorporated by reference, and this patent document also claims the benefit of DE 10 2012 217 191.6, filed on Sep. 24, 2012, which is also hereby incorporated by reference.

TECHNICAL FIELD

The embodiments relate to a process for producing a component (e.g., refractory metal component) by casting, (e.g., tape casting). The process includes providing a slip that includes a powder of at least one refractory metal or a compound thereof and also at least one binder. The process also includes casting the slip to give at least one slip layer. The embodiments also relate to a component produced by the process. The embodiments may be applied, in particular, to X-ray tubes, accelerator targets, or fusion reactors, in particular, for a surface of an X-ray anode or a wall of a fusion reactor.

BACKGROUND

The surfaces of a wall of a fusion reactor that face the plasma or the surface of an X-ray anode experience not only high temperatures but also high mechanical, thermocyclic stresses that may lead to crack formation or else to melting of the materials. In both applications, refractory metals, (in particular, tungsten), are used.

The tape casting process for refractory metals is known from WO 2007/147792 A1 for producing planar components in the case of tungsten-heavy metal alloys. WO 2007/147792 A1 discloses a process for producing flat, shaped objects composed of a tungsten- or molybdenum-heavy metal alloy, in which a slip for tape casting is produced therefrom, a sheet is cast from the slip and the sheet is dried and subjected to binder removal and sintered in order to obtain the shaped object. The term tungsten- or molybdenum-heavy metal alloy refers, in the sense of WO 2007/147792 A1, to materials selected from the group consisting of tungsten-heavy metal alloys, tungsten, tungsten alloys, molybdenum, and molybdenum alloys. Tungsten-heavy metal alloys include from about 90% by weight to about 97% by weight of tungsten or tungsten alloys. The remainder is made up of binder metals. As metallic binders, mention may be made primarily of the elements Fe, Ni, and/or Cu in proportions of greater than 1% by mass. The metallic binders provide simplified production processes by relatively low sintering temperatures, improved mechanical properties, in particular ductility, and improved workability, e.g., a better ability to undergo cutting machining. These materials are aimed at use in applications for radiation shielding, with a high density of the alloys being of primary importance.

SUMMARY AND DESCRIPTION

The scope of the present invention is defined solely by the appended claims and is not affected to any degree by the statements within this summary. The present embodiments may obviate one or more of the drawbacks or limitations in the related art.

It is an object of the present embodiments to at least partly overcome the disadvantages of the prior art and, in particular, provide a refractory metal component that is more stable under thermal change point stresses.

The object is achieved by a process for producing a component (hereinafter also referred to as "refractory metal component") by casting, wherein the process includes providing a slip that includes a powder of at least one refractory metal or a compound thereof ("refractory metal powder") and at least one binder. The process also includes casting of the slip to give at least one slip layer. The slip is metal binder-free, e.g., does not contain a metallic binder. The absence of the metal as binder may be realized, in particular, by an absence of metal, mixtures, or alloys thereof as independent powder in the slip. The state of the cast slip is referred to as "green" because of the organics still present. In this state, a "green sheet", "green component" or "green coating" is obtained as semi-finished part.

Such a process has the advantage that the materials properties of the finished refractory metal component, (in particular, its high melting point and its fracture strength under thermal change stress), are not impaired by the low-melting metal or metals in the binder (which would otherwise be the case). As a result, a component produced in this way may withstand higher temperatures without destruction and/or have a longer life. The process is not or not significantly more complicated to carry out than when a metallic binder is present.

It is in this way possible (e.g., in contrast to a rolling process) to produce homogeneous, isotropic, fine-grained, and low-stress microstructures of the final refractory metal component having a narrowly distributed and fine grain size distribution. This may, in particular, also be associated with an isotropic crystal orientation. The setting of, for example, a bimodal grain size distribution is sometimes also desired and possible with a view to the mechanical properties. In addition, no textures, lower residual stresses, and misorientations of the grains in the material are achieved, e.g., in contrast to a rolling process. Furthermore, the grain boundary properties and thus the fracture behavior under thermocyclic point loads may also be influenced via setting of the grain structure (e.g., distribution/size). In addition, the process makes it possible to produce large-area refractory metal components.

The term refractory metal component may, in principle, refer to any body or workpiece that has been produced by the process.

A slip may be any solids-containing suspension that has the refractory metal powder as solid and is suitable for carrying out casting. The slip may, in particular, be a refractory metal powder/liquid mixture having a defined viscosity, in particular, having a water-free liquid.

A powder composed of at least one refractory metal or a compound thereof may, in particular, be one or more powders composed of one or more pure refractory metals (e.g., tungsten and/or molybdenum), alloys thereof (e.g., tungsten-rhenium) and/or compounds thereof. The refractory metal powder may, for example, include tungsten, molybdenum, rhenium, and/or tantalum and/or alloys thereof and/or compounds thereof. In one particular embodiment, the powder is a powder composed of pure tungsten, tungsten-rhenium, WRe, or tungsten-tantalum, WTa.

In an embodiment, processing of the at least one refractory metal powder is carried out in the absence of oxygen, (e.g., under a protective gas atmosphere), a reducing atmosphere, or under reduced pressure. This prevents oxidation of the refractory metal powder.

In another embodiment, the proportion of the refractory metal or the compound thereof in the slip is from 70% by weight to 99% by weight.

The binder may, in principle, be any nonmetallic binder or binder without metal powder. The binder binds the refractory metal powder in a manner similar to an adhesive. In certain embodiments, the binder is an organic binder, e.g., polyvinyl butyral.

In an embodiment, the slip includes additional additives such as dispersants, plasticizers, solvents, etc. In this way, it is possible, in particular, to influence a viscosity of the slip and the properties of the cast sheet (e.g., the strength or deformation capability thereof).

A dispersant provides that the wetting behavior of the particles of the refractory metal powder is improved and agglomerate formation is suppressed. The solvents, e.g., ethanol and/or toluene, dissolve organic components, in particular, of the binder, e.g., Pioloform BR18. The addition of a plasticizer makes it possible to adjust the flexibility and strength of the cast slip layer and thus its handleability. A homogeneous slip is produced by various mixing and milling processes. It may be necessary to degas the slip before casting in order to avoid bubble formation in the slip layer.

To produce the slip, mixing of the individual powders may, for example, be carried out in a tumble mixer, in ball mills, etc.

In an embodiment, casting includes tape casting or a tape casting process. The technique of tape casting is well known in principle and does not need to be explained further here. All suitable tape casting processes may be employed in principle. The slip layer produced may in the case of tape casting also be referred to as green sheet that is cast onto a carrier tape. The green sheet may be an independent workpiece that is, in particular subsequently, processed by thermal processes to give the end product.

In an embodiment, the green sheet is applied directly to a component and, in particular, passed through the subsequent thermal treatment as a joined component. A component having a refractory metal coating is formed.

In an embodiment, the casting includes slip casting or a slip casting process. Here, a support is pulled through the slip or sprayed therewith one or more times. The support may also include the component to be coated in this way. The deposited slip layer may then be thermally treated (in particular, subjected to binder removal and/or sintered) together with the support. This forms a refractory metal component having the support as substrate and at least one refractory metal layer.

The slip layer may, in particular, be present as a thin layer of the slip, in particular, still contain the organic binder. The slip layer, (e.g., green sheet), may, in particular, be dimensionally stable for further processing.

In an embodiment, the slip includes ceramic particles. In this way, it is possible to influence, inter alia, the recrystallization behavior and/or the strength of the subsequently produced refractory metal component. The presence of ceramic also stabilizes, in particular, a fine grain structure by dispersion hardening and suppresses recrystallization, as a result of which the refractory metal component is provided with increased resistance to thermal shock (e.g., triggered by a thermal change point stress).

In another embodiment, the ceramic includes $La_2O_3$, $Y_2O_3$, TiC, and/or HfC.

The ceramic particles may be present in the slip as, in particular, ceramic powder. A ceramic powder may, in particular, be present as nanopowder or micropowder. Mixing of ceramic and metallic powders may be effected together with other slip components or be achieved by an optional, preceding mixing and milling process (e.g., in a ball mill, an attritor, etc.). Here, inter alia, a particle size distribution may also be set.

In a further embodiment, a median of the particle size of at least one refractory metal powder, D50, is less than two microns. These small particle sizes suppress grain growth as a result of high sintering temperatures since the use of such fine powder fractions makes a high sintering reactivity and therefore lower final sintering temperatures possible.

In another embodiment, a thickness of the (individual) slip layer(s) is from about twenty microns to about three millimeters. In this way, it is possible to provide a sufficiently great layer thickness to accommodate a plurality of particles of the refractory metal powder. In addition, satisfactory homogeneity of the individual slip constituents over the thickness may be provided.

In an embodiment, a layer thickness corresponds to at least about five times to ten times the largest particles of the at least one refractory metal powder and/or ceramic powder. This prevents a sheet being made up of only a few grains over its thickness or height. This in turn improves the mechanical properties.

In another embodiment, the slip is applied by tape casting (e.g., as green sheet) to a carrier tape. This makes handling of the green sheet, for example, shaping and/or stacking thereof, easier. The carrier tape may subsequently be removed again, e.g., drawn off, e.g., before heat treatment of the green sheet.

In a further embodiment, a plurality of (e.g., two or more) slip layers, (in particular, green sheets), are stacked on top of one another. Stacking may include, in particular, lamination and/or successive, multiple casting, and/or isostatic pressing. The stack of layers obtained in this way enables, in particular, large-area objects having a large layer thickness to be sintered in one operation. In addition, a large (e.g., in principle unlimited) thickness of the refractory metal component with constant density of the material may be achieved in this way.

In a variant thereof, at least two (e.g., stacked) slip layers, (in particular, green sheets), of the stack of layers differ in terms of their properties. In particular, the thermomechanical properties and the fracture behavior of the stack of layers may be structurally matched. Furthermore, such a stack of layers makes it possible to produce connecting zones that allow joining of refractory metal to other components, e.g., an anode support or a support for plasma chamber components in a fusion reactor. It is also possible to influence stresses caused by different coefficients of thermal expansion of the components or the reaction behavior at the interfaces.

In an embodiment, the slip layers of the stack of layers have a gradient structure. A gradient structure makes it possible to influence, for example, crack propagation and stress gradients. A property may be, in particular, a content of refractory metal, a type and/or composition of the refractory metal or a compound thereof (e.g., a content of W, Ta, Re, Mo, etc.), a presence, a type and/or a content of ceramic, a microscopic structure (e.g., a grain size distribution) and/or a macroscopic structure (e.g., a size of the powder particles, a porosity, etc.). For example, a gradient structure may be achieved by layering of W sheets with W/Re sheets, or dense tungsten layers alternate with porous tungsten layers. The porosity may, for example, be set via the sintering activity of the refractory metal powders. The gradient material may, in particular, be characterized by a gradual (in particular, stepwise) change in at least one property of the slip layers over the stack thickness of the stack of layers.

A plurality of slip layers (e.g., in a manner analogous to a plurality of green sheets) may also be applied to the support, (e.g., as gradient layers), by the slip casting process.

In an embodiment, the act of casting of the slip is followed by an act of shaping of the green sheet(s).

The green sheet(s) may, for example, be cut to a desired geometry by a knife. A flexible green sheet may also be brought into various geometries (e.g., in the form of a tube). The process therefore allows not only the production of flat layers but also the production of three-dimensional green bodies or refractory metal components.

In another embodiment, the act of casting of the slip is followed by an act of heat treatment of the at least one slip layer. In this way, a solid, near-final-shape refractory metal component may be produced from the slip, e.g., green sheet.

A heat treatment may include, in particular, heat treatment of the green body to give the refractory metal component.

The heat treatment may include an act of removal of binder from the at least one slip layer. Here, the at least one slip layer may be heated to such a temperature that the binder is removed (e.g., thermal binder removal). As an alternative or in combination therewith, binder removal may be effected by chemical binder removal in which the organic constituents of the binder may be dissolved out from the slip, in particular green sheet or green body, by solvents.

The heat treatment may also include an act of sintering of the at least one slip layer. A densified refractory metal component is obtained as a result. Sintering may, in particular, follow binder removal. Sintering may be, in particular, atmospheric-pressure sintering.

Binder removal and sintering may be carried out in one operation in specific combined sintering plants that allow clean binder removal and subsequent sintering. This avoids relocation of the components and shortens the process time.

Particularly in the case of a slip layer composed of pure tungsten as refractory metal, a single-transit process in a reducing and carbon-free atmosphere may be provided in order to keep the carbon content and oxygen content low.

In another embodiment, sintering is carried out not at the maximum sintering temperature in order to immediately achieve complete densification but instead at lower sintering temperatures. This enables grain growth to be inhibited, which aids the formation of a homogeneous and isotropic, fine-grained microstructure. It may in this case be sufficient, in particular, for a closed porosity and not a maximal density to be obtained in the component. Sintering in which the workpiece has a non-negligible (e.g., closed) porosity and which is followed by a further heat treatment act may also be referred to as pre-sintering.

Particularly to attain a still higher density (in particular, in the region of a maximum theoretical density) at low working temperatures in previously pre-sintered workpieces, the act of, in particular atmospheric-pressure, (pre)sintering is, in another embodiment, followed by a further (e.g., high-temperature) heat treatment act, e.g., hot isostatic pressing.

The act of heat treatment may thus include an act of hot pressing, in particular, hot isostatic pressing, of the at least one (pre)sintered slip layer.

The act of heat treatment may, as an alternative or in addition, include an act of "spark plasma" sintering. The green semi-finished part, the material that has been subjected to binder removal and/or the material that has been pre-sintered at comparatively low temperatures (a closed porosity is not necessary here) has electric current passed through it at elevated pressure and is thus brought to the final density in a short time and at comparatively low temperatures. A combination of binder removal and sintering in one operation is in principle also possible in "spark plasma" sintering.

The act of heat treatment may, as an alternative or in addition, include an act of microwave sintering. Here, the green semi-finished part, the material from which the binder has been removed and/or the material that has been presintered at comparatively low temperatures is irradiated with microwaves in order to bring it to the final density at low temperatures. A combination of binder removal and sintering in one operation is in principle also possible in the case of microwave sintering.

An embodiment consequently provides for the act of heat treatment to include an act of sintering below a maximum sintering temperature to a density below the maximum density and subsequently a heat treatment act of further densification.

An embodiment for producing a particularly stable, in particular thermal shock-resistant, refractory metal component includes at least one slip layer being made at least closed-pored by the heat treatment. "At least closed-pored" may refer to a closed-pored or dense state (in particular, a state of maximum density).

The refractory metal components produced by the above process (e.g., plates or structures, such as tubes) may represent the end product or may be applied as semi-finished part to surfaces by conventional joining techniques, e.g., soldering. As an alternative, green sheet(s) may be applied to components in furnace processes. In this case, these components have to go through the thermal treatment of the green sheet in a manner similar to the case of the slip casting process.

The object is also achieved by a component (e.g., refractory metal component) or a body that has been produced by the process as described above.

This component may, in particular, have an isotropic, fine-grained microstructure.

The component may, in particular, be configured in a manner analogous to the process and have the same advantages.

In an embodiment, the refractory metal component thus includes ceramic or ceramic particles. In another embodiment, the ceramic particles includes $La_2O_3$, $Y_2O_3$, TiC, and/or HfC.

In a further embodiment, a median of the particle size of at least one refractory metal powder, D50, is less than two microns.

In a further embodiment, the refractory metal component includes a plurality of (two or more) layers that may differ, in particular, in terms of their properties. In particular, the layers may have a gradient structure.

In a further embodiment, the refractory metal component is a three-dimensional component.

In another embodiment, the refractory metal component is a closed-pored component or a dense component.

In an embodiment, the component may be employed for X-ray tubes, accelerator targets, or fusion reactors, in particular, as a surface of an X-ray anode or as a wall of a fusion reactor. In these applications, the use of, for example, a low-melting metallic binder would be very disadvantageous in respect of heat resistance.

BRIEF DESCRIPTION OF THE DRAWINGS

The above-described properties, features, and advantages, and also the way in which they are achieved, will be made clearer and more understandable in connection with the following schematic description of an example that will be explained in connection with the drawings. In the interest of clarity, identical elements or elements having the same effect will be provided with the same reference symbols.

DETAILED DESCRIPTION

Figure 1:
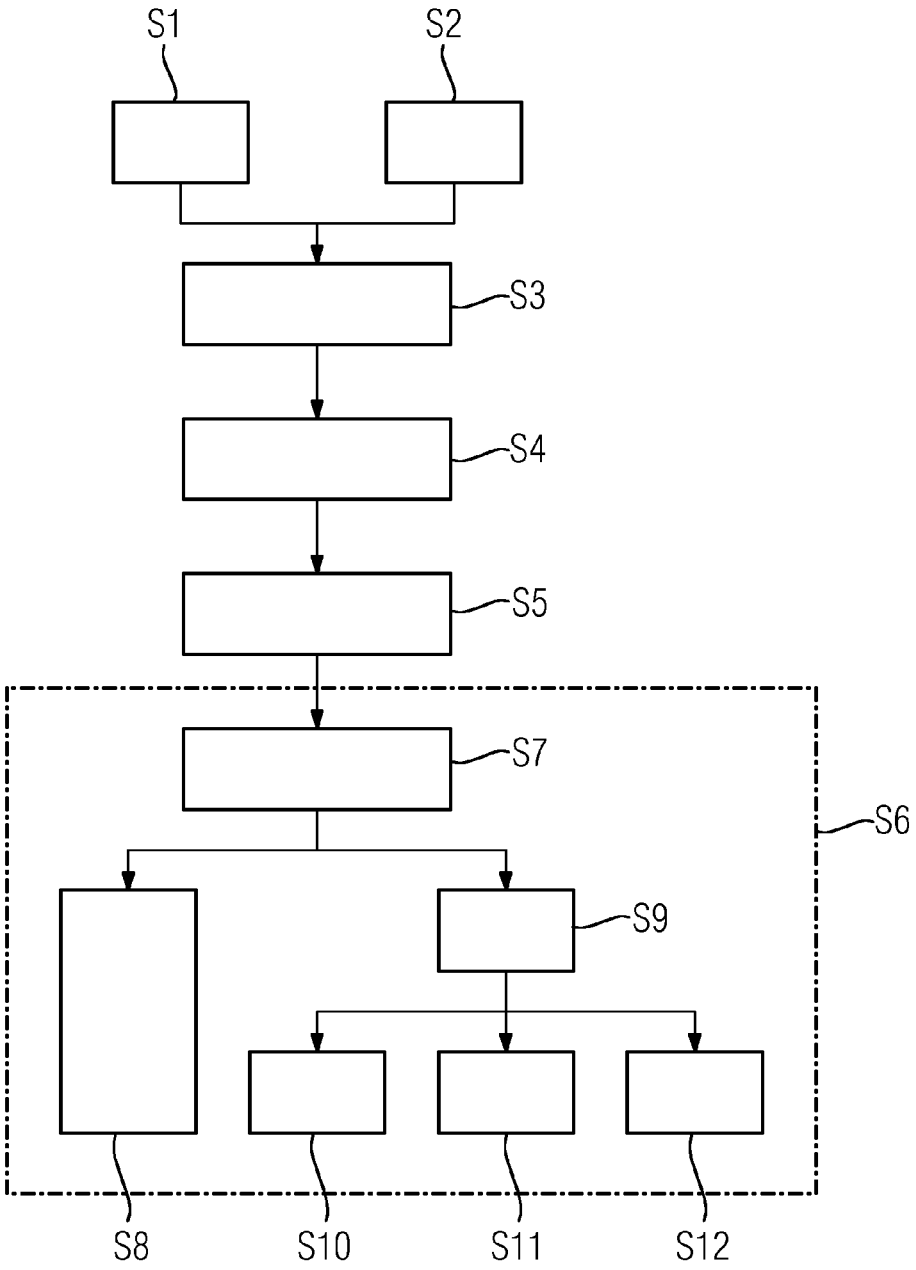
FIG. 1 depicts an embodiment of the course of a process in a number of variants.

FIG. 1 depicts the course of a process for producing a refractory metal component by tape casting in a number of variants.

Act S1 includes providing a powder mixture composed of refractory metal powder in the form of two tungsten powders. The two tungsten powders differ in terms of their average particle size, D50, namely in one case 0.7 microns and in one case 1.7 microns.

Act S2 includes provision of additives such as a dispersant (Hypermer KD1), solvents in the form of ethanol and toluene and also a binder in the form of polyvinyl butyral (Pioloform BR 18) and a plasticizer in the form of dibutyl phthalate.

To produce the slip, the constituents of the slip S (see also FIG. 2) are mixed in act S3 and thereby provided. For this purpose, the refractory metal powders, the dispersant, and the liquids are firstly mixed in a speed mixer for three minutes at 1400 l/min. The binder, to which ethanol has already been added, and the plasticizer are subsequently added and the mixture is mixed in the speed mixer at 1500 l/min for ten minutes.

The dispersant provides that the wetting behavior of the refractory metal powder particles is improved and agglomerate formation is suppressed. The solvents ethanol and toluene dissolve the organic components, in particular, the Pioloform BR18 binder. Mixing-in of a plasticizer enables the cast sheet to be made flexible and strong and thus readily handleable. A homogeneous slip is produced by various further mixing and milling processes. In some cases, it may be necessary to degas the slip before tape casting in order to avoid bubble formation in the sheet. A proportion by weight of metallic powder of from 70% to 99% in the slip S is sought.

Figure 2:
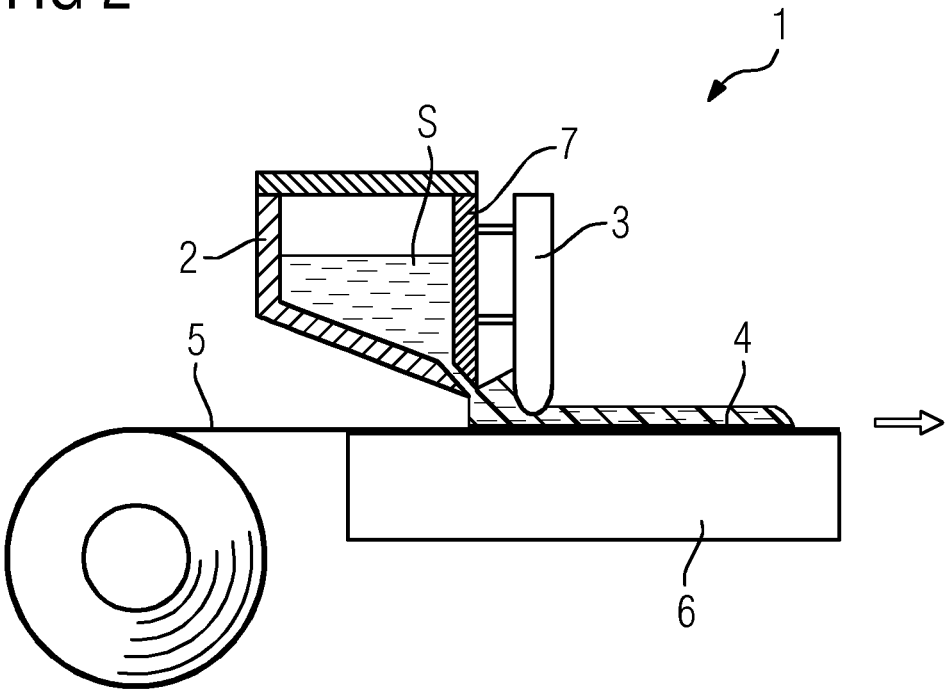
FIG. 2 depicts an embodiment of an apparatus for tape casting in order to carry out the process.

The slip S is subsequently introduced into a stock tank 2 of a tape casting plant 1 as depicted in FIG. 2 for carrying out act S4 of tape casting. The slip S flows from the stock tank 2 and is spread by a doctor blade 3 as green sheet 4 on a carrier tape 5. The carrier tape 5 rests on a flat underlay 6 during this operation. A preliminary blade 7 preceding the doctor blade 3 makes it possible to set a hydrostatic pressure upstream of the doctor blade 3 that thus influences the thickness of the cast green sheet 4. The viscosity of the slip S and the drawing speed (relative velocity between carrier tape 5 and doctor blade 3 in the direction of motion indicated by the arrow) likewise influence the thickness of the cast green sheet 4.

The minimum sheet thickness is limited, in particular, by the particle size of the starting powders and corresponds approximately to 5 to 10 times the largest particles. In the case of starting powders as above (in particular, D50=1.7 microns), the lower limit of the cast green sheet 4 is approximately 60 microns.

The maximum thickness of the green sheet 4 is from about 1.5 mm to 2.0 mm.

In act S5, the green sheet 4 may be cut to size and/or shaped, in particular given a three-dimensional shape.

In an additional act, the carrier tape 5 is pulled off from the green sheet 4.

In act S6, the cut-to-size/shaped green sheet 4 is heat treated in order to produce the finished refractory metal component.

In act S7, the green sheet 4 is subjected to binder removal, in particular, by a heat treatment.

In act S8, the green sheet 4 that has been subjected to binder removal and optionally shaped is sintered in a contiguous, in particular, atmospheric-pressure, sintering process at an appropriately high sintering temperature until a dense or virtually pore-free refractory metal component has been obtained.

In an alternative to act S8, the green sheet 4 that has been subjected to binder removal and optionally shaped is firstly sintered at a comparatively lower sintering temperature ("presintered") in act S9 in which it does not yet reach its dense state but remains porous (open-pored or closed-pored).

In act S10, the presintered workpiece is densified, in particular, densified so as to be pore-free, in particular, to its maximum density, by hot isostatic pressing to give the refractory metal component. This has the advantage that the temperatures required for hot isostatic pressing are lower than the sintering temperature required in act S8 and grain growth (which increases with increasing temperature) is thus inhibited.

As an alternative to or in addition to act S10, act S11 of spark plasma sintering and/or act S12 of microwave sintering may be carried out.

Although the invention has been illustrated and described in detail by the example presented, the invention is not restricted thereto and other variations may be derived therefrom by a person skilled in the art without going outside the scope of protection of the invention.

Thus, ceramic powder may also be added to the slip.

In addition, it is possible, for example, for a further act of stacking (optionally including lamination and/or isostatic pressing) of green sheets 4 to give a stack of layers to be carried out between act S4 and act S5. Such a further act may also include stacking of green sheets 4 from different tape casting plants 1 or different batches from the tape casting plant 1, especially if these green sheets 4 differ.

A layer structure or gradient structure may be obtained, in particular, by multilayer casting. Here, a plurality of slip layers are applied in succession (or simultaneously) in modified tape casting plants.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A process for producing a surface of an X-ray anode or a wall of a fusion reactor by casting, wherein the process comprises:

providing a slip comprising a powder of at least one refractory metal or a compound thereof and also at least one binder, wherein a proportion of the refractory metal in the slip is 70% by weight to 99% by weight; and tape casting or slip casting the slip to provide a plurality of slip layers having individual slip layers stacked on top of one another, wherein the slip is free of a metal binder.

2. The process as claimed in claim 1, wherein the slip further comprises ceramic particles.

3. The process as claimed in claim 2, wherein the ceramic particles comprise one or more of the following: $La_2O_3$, $Y_2O_3$, TiC, or HfC.

4. The process as claimed in claim 2, wherein a median of a particle size of the powder is less than two microns.

5. The process as claimed in claim 1, wherein the powder is a powder of pure tungsten, WRe, or WTa.

6. The process as claimed in claim 1, wherein the binder comprises at least one organic binder.

7. The process as claimed in claim 1, wherein a layer thickness of a slip layer of the plurality of slip layers is 20 microns to 3 millimeters.

8. A process for producing a surface of an X-ray anode or a wall of a fusion reactor by casting, wherein the process comprises:

providing a slip comprising a powder of at least one refractory metal or a compound thereof and also at least one binder, wherein a proportion of the refractory metal in the slip is 70% by weight to 99% by weight; and tape casting the slip to a carrier tape to provide at least one flexible slip layer, wherein the slip is free of a metal binder.

9. The process as claimed in claim 1, wherein at least two slip layers of the plurality of slip layers differ in terms of their respective properties.

10. The process as claimed in claim 1, wherein the processing of the slip is followed by heat-treating the plurality of slip layers.

11. The process as claimed in claim 10, wherein the heat-treating comprises sintering below a maximum sintering temperature to a density below a maximum density and subsequently a further heat-treating of further densification.

12. The process as claimed in claim 10, wherein the plurality of slip layers becomes at least closed-pored as a result of the heat-treating.

13. The process as claimed in claim 1, wherein the plurality of slip layers comprises green sheets.

14. The process as claimed in claim 10, wherein the heat-treating comprises sintering of the plurality of slip layers.

15. The process as claimed in claim 1, wherein the plurality of slip layers is a gradient structure achieved by layering tungsten sheets with tungsten-rhenium sheets.

16. The process as claimed in claim 1, wherein the plurality of slip layers is a gradient structure achieved by layering alternating dense tungsten sheets and porous tungsten sheets.

17. The process as claimed in claim 1, wherein the slip further comprises a plasticizer.

* * * * *